US007681922B2

(12) United States Patent
Galatello Adamo et al.

(10) Patent No.: US 7,681,922 B2
(45) Date of Patent: Mar. 23, 2010

(54) CONNECTION BETWEEN COOLED PIPE AND UNCOOLED PIPE IN A DOUBLE-PIPE HEAT EXCHANGER

(75) Inventors: Gaetano Galatello Adamo, Lissone (IT); Luca Zanardi, Bergano (IT); Pietro Ricci, Crema (IT)

(73) Assignee: OLMI S.p.A., Suisio BG (IT)

( * ) Notice: Subject to any disclaimer, the term of this patent is extended or adjusted under 35 U.S.C. 154(b) by 986 days.

(21) Appl. No.: 11/431,638

(22) Filed: May 11, 2006

(65) Prior Publication Data

US 2006/0267340 A1 Nov. 30, 2006

(30) Foreign Application Priority Data

May 11, 2005 (IT) ..... MI2005A0847

(51) Int. Cl.
*F16L 53/00* (2006.01)
*F28D 7/10* (2006.01)

(52) U.S. Cl. ..... 285/41; 285/123.1; 285/288.1; 165/141

(58) Field of Classification Search ..... 285/41, 285/123.1, 123.2, 123.3, 288.1, 288.2, 288.11, 285/397; 138/89.1, 91, 94, 96 R, 111, 114, 138/DIG. 11; 165/141, 154, 155, DIG. 84, 165/DIG. 141, DIG. 160, DIG. 332, DIG. 338, 165/DIG. 534

See application file for complete search history.

(56) References Cited

U.S. PATENT DOCUMENTS 3,536,584 A * 10/1970 Rawson et al. ..... 376/463
4,079,967 A * 3/1978 Schoessow ..... 285/47
4,315,644 A * 2/1982 Jansing ..... 285/179
4,644,780 A * 2/1987 Jeter ..... 73/40.5 R
5,104,155 A * 4/1992 Kirkwood ..... 285/125.1
5,141,261 A * 8/1992 Ziu ..... 285/123.1
5,345,484 A * 9/1994 Deaver et al. ..... 376/407
5,579,831 A * 12/1996 Brucher ..... 165/134.1
5,690,168 A * 11/1997 Cizmar et al. ..... 165/134.1
6,218,029 B1 * 4/2001 Rickerby ..... 428/615
6,345,084 B1 * 2/2002 Jensen ..... 376/352
2005/0212285 A1 * 9/2005 Haun ..... 285/123.1
2008/0149210 A1 * 6/2008 Pionetti ..... 138/144

FOREIGN PATENT DOCUMENTS

EP 19908 A1 * 12/1980
JP 01188792 A * 7/1989
JP 04331885 A * 11/1992

* cited by examiner

*Primary Examiner*—Victor MacArthur
*Assistant Examiner*—Jay R Ripley
(74) *Attorney, Agent, or Firm*—Jacobson Holman PLLC

(57) ABSTRACT

A union connection between uncooled pipe and cooled double-wall pipe in a heat exchanger comprising a double-wall pipe comprising in turn an internal pipe traveled by a fluid to be cooled and an external pipe defining with the internal pipe an air space traveled by a cooling fluid with one end of the double-wall pipe being connected to an inlet duct of the fluid to be cooled through a connection part also forming a bottom wall of the air space virtually transversal to the double-wall pipe extension and characterized in that the connection part has an annular form with U cross section to define two annular shanks extending longitudinally to the pipe with each shank being welded to one end of one of the two pipes of the double-wall pipe and in that the end of the inlet duct is welded to the connection part at said bottom wall of the air space.

15 Claims, 1 Drawing Sheet

CONNECTION BETWEEN COOLED PIPE AND UNCOOLED PIPE IN A DOUBLE-PIPE HEAT EXCHANGER

BACKGROUND OF THE INVENTION

1. Field of the Invention

This invention relates to an innovative connection between cooled pipe and uncooled pipe in a double-pipe heat exchanger of the type used, for example, to cool high temperature cracking gas in so-called Transfer Line Exchangers (TLEs).

2. State of the Prior Art

In these exchangers the double-wall pipe comprises an internal pipe traveled by the fluid to be cooled (for example, cracking gas coming out of an oven) and an external pipe delimiting with the internal one the air-space traveled by the cooling fluid (for example, water) with the cooling fluid injected into the air space through a union on the side wall of the outermost pipe and in general near the inlet end of the double-wall cooled pipe. The cooling fluid is then taken from the air space near the output end of the double-wall pipe.

The double-wall pipe must be connected upstream with a single-wall pipe inlet pipe feeding the hot fluid to be cooled and which is at a relatively high temperature. It is to be considered for example, that, in ethylene plants, the incoming hot fluid has a temperature over 800° C.

In the field of heat exchangers of this type the problems had at the connection between the cooled double-wall pipe and the inlet pipe of the fluid to be cooled are well known.

To realize the union, it has been proposed to use a forked connection having on one side two shanks designed for the connection with the two pipes of the double-wall pipe and, on the other side, a shank stretching longitudinally to be jointed with the inlet pipe of the fluid to be cooled.

During operation the forked connection is subjected to a considerable thermal stress due to the high temperature reached by its shank which is connected to the hot-fluid inlet pipe.

To avoid the fork in the long run being damaged because of excessive thermal stress, it has been proposed to insert at the height of the fork in the duct of the fluid to be cooled a transition cone which would by-pass the critical portion of the connection and cause the gasses in temperature downstream of the fork and already inside the double-wall pipe to flow.

These solutions complicate not a little the design of the exchanger by forcing insertion of the supplementary cone and, possibly, even a refractory ring between the cone and the fork to improve distribution of the temperature at the fork.

In addition, the gas to be cooled meets on its path irregularities which disturb the gas flow and cause formation of coke in the apparatus. The irregularity consists of the floating 'sleeve' arranged generally at the inlet of the double pipe and capable of absorbing the differential dilation between the outer wall of the cone in contact with the air and the inner wall of the pipe in contact with the hot gas. The coke, by attrition, obstructs dilations of the 'sleeve' which occur at each startup of the exchanger and compromise mechanical integrity. In addition, coke formation causes fouling and decrease in the efficiency of the exchanger.

Lastly, lengthening of the geometry causes an increase in the gas stay time in the exchanger with resulting worsening of the product final output.

The general purpose of this invention is to remedy the above-mentioned shortcomings by making available a connection for a heat exchanger with double-wall pipes and having a simple, economical structure and which at the same time is durable and resistant to the operating temperatures of the exchanger in every part thereof.

Another purpose of this invention is to make available a connection for the double-pipe heat exchanger allowing avoidance of the formation of coke as well as high efficiency.

SUMMARY OF THE INVENTION

In view of this purpose it was sought to provide in accordance with this invention a union connection between uncooled pipe and cooled double-wall pipe in a heat exchanger comprising a double-wall pipe comprising in turn an internal pipe traveled by a fluid to be cooled and an external pipe defining with the internal pipe an air space traveled by a cooling fluid with one end of the double-wall pipe being connected to an inlet duct of the fluid to be cooled through a connection part forming also a bottom wall of the air space virtually transversal to the double-wall pipe extension and characterized in that the connection part has an annular form with U cross section to define two annular shanks extending longitudinally to the pipe with each shank being welded at one end of one of the two pipes of the double-wall pipe and in that the end of the inlet duct is welded to the connection part at said bottom wall of the air space.

BRIEF DESCRIPTION OF THE DRAWINGS

To clarify the explanation of the innovative principles of this invention and its advantages compared with the prior art there is described below with the aid of the annexed drawing a possible embodiment thereof by way of non-limiting example applying said principles.

DETAILED DESCRIPTION OF THE INVENTION

Figure 1:
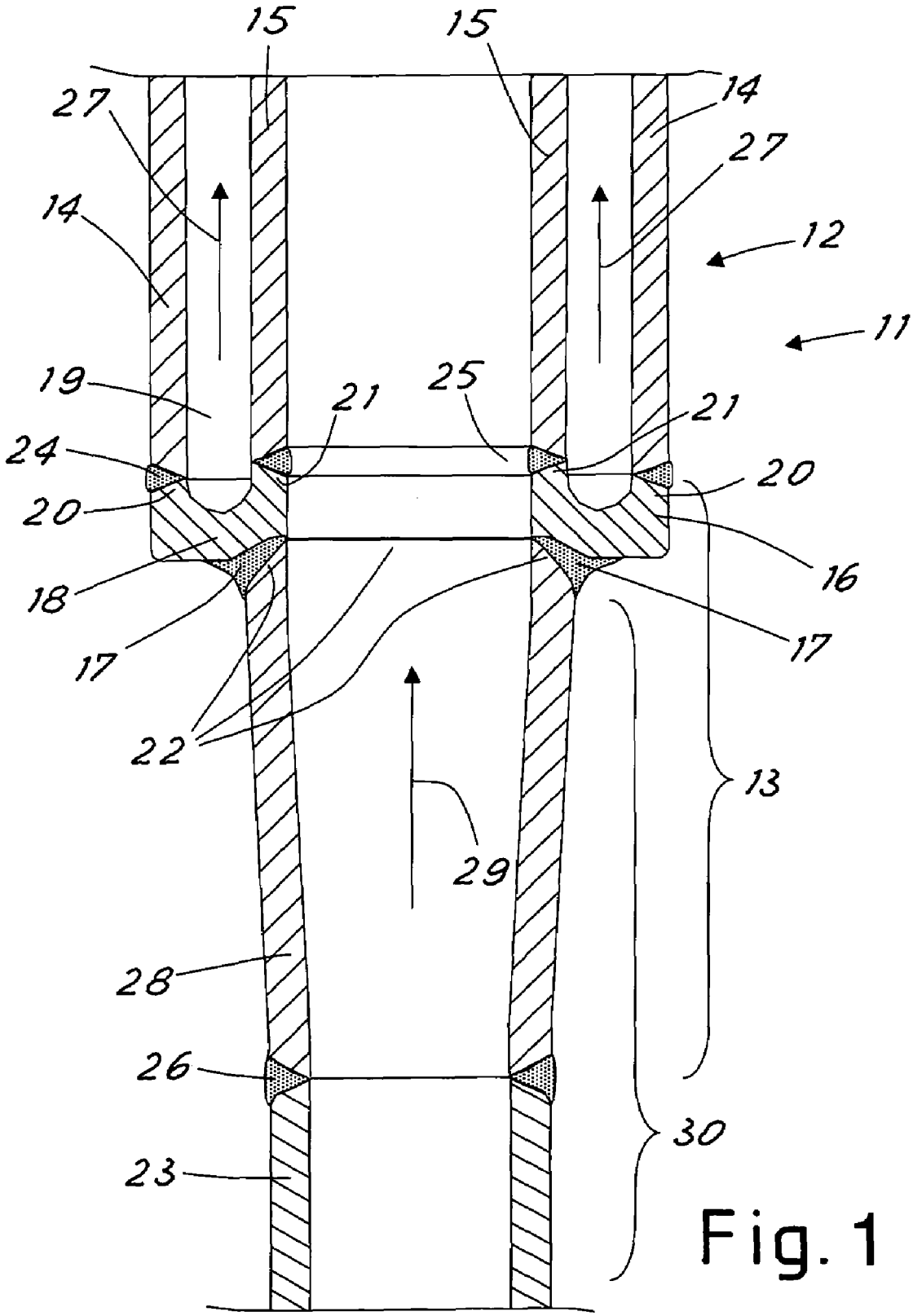
FIG. 1 shows a longitudinal cross-section view of the connation zone between the double-wall pipe of the exchanger and the high-temperature fluid inlet duct.

The FIGURE shows one part of a heat exchanger in the connection zone 11 of a double-wall pipe designed, for example, to be used for cooling high-temperature cracking gas (over 800° C.).

The exchanger comprises a double-wall pipe 12 made up of an internal pipe 15 traveled by the fluid to be cooled and an external pipe 14 defining with the internal pipe 15 an air space 19 traveled by a cooling fluid.

At the inlet end, the double-wall pipe 12 must be connected to a single-wall pipe 23 for inlet of the fluid to be cooled. To achieve this, a union connection 13 is used comprising a connection part 16 and, advantageously but not exclusively, a union sleeve 28. The sleeve 28 together with the inlet pipe 23 form an inlet duct 30 for the hot fluid to the double-wall pipe 12.

The pipe 12 is connected at its opposite end to an outlet duct for the cooled cracking gas (not shown in the FIGURE). This outlet union can be realized in accordance with the prior art in the field or similarly to the union 11 and is not further described.

In accordance with this invention the connection part 16 is not realized as a fork but as a U to form a bottom wall 18 of the air space 19 virtually transversal to the pipe axis 12. The bottom wall 18 forms in fact a ring extending transversely to the pipe 12 in such a manner as to delimit in longitudinal direction the extension of the air space 19. The end 22 of the inlet duct 30 is then welded to the connection part 16 through the weld 17 at said bottom wall 18 of the of the air space 19.

It is noted incidentally that the inlet duct 30 could be made up exclusively of an inlet pipe similar to the pipe 23 if it were appropriately sized and insertion in the sleeve connection 28 were not necessary.

It was surprisingly found that this stratagem allows always keeping the temperature of the material of the connection part 16 at a sufficiently low level to avoid that it might have to undergo unacceptable thermal stresses, plasticization and creep phenomena without the need of refractory shielding or flow switches.

It was found that the connection part 16 never reaches excessively high temperatures (never more than 500° C. even in the presence of inlet fluid over 800° C.). In particular, the need was seen that the distance of the weld 17 from the air space bottom 19 be on the order of the wall thickness 15. In dimensional terms, it is advantageous that the thickness of the material of the connection part 16 between the cooling fluid (in the air space) and the weld 17 be always less than 30 mm and preferably less than 15 mm. It was found extremely advantageous to choose the thickness between 10 mm and 12 mm.

During operation, between the cooled uncooled parts there can be a considerable temperature jump distributed over a short distance. This temperature gradient, though not so high in the 'fork' geometry, is responsible for internal strains and unacceptable deformations in the connection when realized forklike with an axial annular shank projecting in a single piece as regards the air space bottom to be connected to the hot-fluid inlet pipe in accordance with the prior art.

In accordance with the prior art on the contrary at the thermal gradient a transition of materials is realized in such a manner that during operation each material remains at a temperature acceptable for it while avoiding causing internal strains and unacceptable permanent deformations in the exchanger.

Advantageously the weld end 22 of the inlet duct 30 is metallized in 6617 alloy to compensate for the differential dilations which can occur between the material of the sleeve 28 (made advantageously of 8811 alloy or 8810 alloy) and the material of the connection part 16 (realized advantageously of 2.25 Cr—0.5 Mo material thanks to the fact that the temperature in the connection point is kept sufficiently low to allow use of said material).

All materials in every component and every point always work within the elastic limits to avoid formation of permanent deformations.

In a preferred realization of this invention the connection part 16 has an annular form with U cross section in such a manner as to define two annular shanks 20, 21 each welded to one of the two pipes 14, 15 of the double-wall pipe and an appropriately beveled edge for welding.

Basically, the thickness of the 'pipe plate' is limited to achieve an acceptable temperature profile.

In particular, the shank 20 is welded to the external pipe 14 with the weld 24 while the shank 21 is welded to the internal pipe 15 with weld 25. Each shank 20, 21 projects axially from the bottom wall 18 which in actual fact forms the U bottom. The shanks 20, 21 can have variable length axially.

In the realization in the FIGURE the thickness of the air space 19 (equal to the distance between the two shanks 20 and 21) is approximately double the thickness of the pipe walls 12 (which is equal to the thickness of the two shanks).

Advantageously the portions of the connection part 16 and of the inlet duct 30 welded together present a conical outline tapered in the direction 29 of the cooling-fluid flow. This way, the weld 17 is nearly perpendicular to the temperature gradient between the end 22 and the bottom 18 of the air space, thus allowing realization of an optimal temperature distribution and avoiding temperature differences too high in the material.

Advantageously, as may be seen in FIG. 1, the weld 17 extends virtually inclined to the axis of the pipe at an angle between 30° and 60°.

The bottom wall 18 of the air space has a thickness less than 30 mm and preferably between 10 mm and 12 mm.

It is noted that the wall 18 has a thickness nearly equal to the thickness of the wall of the internal pipe 15, the external tube 14 and the inlet duct 30.

Advantageously as may be seen well in the FIGURE, the inlet pipe 23, the connection 13 and the inner pipe 15 of the double-wall pipe define a duct for the fluid to be cooled free from longitudinal irregularity, which avoids formation of coke in the apparatus.

In accordance with stratagems known in the art, the inlet duct 30 is coaxial with the double-wall pipe 12. The double-wall pipe 12 is realized as a round cylinder with the internal pipe coaxial with the outer one.

In the example of the FIGURE, the sleeve 28, directly welded to the connection part 16, is slightly conical to provide union without irregularity between the diameter of the inlet pipe 23 and the diameter of the pipe 15. It is noted that even the part 28 could be cylindrical and not conical.

The cooling fluid in accordance with known techniques is injected into the air space 19 near the connection part 16 and is taken from the opposite end of the cooled double-wall pipe 12 (not shown in the FIGURE) which is connected to the single-wall cooled fluid outlet pipe. The running direction of the cooling fluid is that indicated by the arrows 27 in FIG. 1.

The cooling fluid inlet into the air space 19 (not shown in the FIGURE) can be realized at different heights in accordance with known techniques in the field of double-pipe exchangers with a union on the external pipe 14.

It is now clear that the preset purposes have been achieved.

Indeed, a union is made available allowing realization of a double-pipe heat exchanger having simplified structure, economical and stout and ensuring durable useful life of the device.

All the materials in every component and at every point always work within elastic limits while avoiding permanent deformations destined to increase with time and compromise the steadiness of the apparatus.

The inventive stratagem proposed allows excluding from the design insertion of transition cones typically used in the prior art, thus reducing installation costs.

In addition, the duct in which the hot fluid flows has a wall without irregularities with nearly constant cross section which avoids formation of coke.

The efficiency of the exchanger is improved due to the fact that the so-called permanence time of the gas before undergoing cooling is minimized since the double pipe of the exchanger can be drawn near the oven outlet as there are no transition cones.

Efficiency is increased also thanks to the absence of coke in the exchanger.

Another advantage of the solution in accordance with this invention is the possibility of adapting exchangers already installed and realized in accordance with prior art with forked union. Indeed, by means of appropriate mechanical processing, the forked union can be converted into a U union in accordance with this invention with the addition then of the duct or sleeve 28 of appropriate length to compensate for the distance between the original inlet pipe and the bottom of the U thus created.

Naturally the above description of an embodiment applying the innovative principles of this invention is given by way of non-limiting example of said principles within the scope of the exclusive right claimed here.

What is claimed is:

1. A union connection between an uncooled pipe and a cooled double-wall pipe in a heat exchanger including a double-wall pipe having in turn an internal pipe traveled by a fluid to be cooled and an external pipe defining with the internal pipe a space traveled by a cooling fluid pipe, the union connection comprising:

a connection part for connection between one end of an inlet duct of the fluid to be cooled and one end of the double-wall pipe, said connection part also forming a bottom wall of the space virtually transversal to a longitudinal extension of the double-wall pipe, the connection part having an annular form with a U-shaped cross section piece having two legs and a perpendicularly extending interconnecting crosspiece to define two annular shanks extending longitudinally to the double-wall pipe with each shank being welded to one end of one of the two pipes of the double-wall pipe, a bottom of the connection part being a bottom wall of the space, and said one end of the inlet duct welded to a radially inner portion of the connection part at said bottom wall of the space such that an interior diameter of the inlet duct is approximately equal to an internal diameter of the internal pipe of the double-wall pipe;

the bottom wall of the space having a thickness almost equal to the thickness of a wall of the internal pipe of the double-wall pipe;

the inlet duct is coaxial with the double-wall pipe.

2. The union connection in accordance with claim 1, wherein the union connection includes a union sleeve welded between the bottom wall of the space and an inlet pipe of the fluid to be cooled with the sleeve thus forming said one end of the inlet duct.

3. The union connection in accordance with claim 2, wherein the union sleeve is realized of alloy 8811 or alloy 8810.

4. The union connection in accordance with claim 1, wherein a thickness of the material of the connection part between the space and the weld with the inlet duct is less than 30 mm.

5. The union connection in accordance with claim 4, wherein the thickness of the material of the connection part is less than 15 mm.

6. The union connection in accordance with claim 1, wherein a thickness of the material of the connection part between the space and the weld with the inlet duct is between 10 mm and 12 mm.

7. The union connection in accordance with claim 1, wherein the bottom wall of the space has a thickness less than 30 mm.

8. The union connection in accordance with claim 7, wherein the bottom wall has a thickness less than 15 mm.

9. The union connection in accordance with claim 1, wherein the bottom wall of the space has a thickness between 10 mm and 12 mm.

10. The union connection in accordance with claim 1, wherein a wall of the inlet duct has a thickness virtually equal to a thickness of the walls of the internal and external pipes of the double-wall pipe.

11. The union connection in accordance with claim 1, wherein the connection part is realized of 2.25 Cr-0.5 Mo material.

12. The union connection in accordance with claim 1, wherein the end of the inlet duct is metallized with alloy 6617.

13. The union connection in accordance with claim 1, wherein the inlet duct, the connection and the internal pipe of the double-wall pipe define a duct for the fluid to be cooled devoid of irregularities longitudinally.

14. The union connection in accordance with claim 1, wherein the portions of the connection part and of the inlet duct welded together have a conical shape tapered in the direction of flow of the cooling fluid.

15. A heat exchanger comprising:

an uncooled pipe with an inlet duct of a fluid to be cooled, a cooled double-wall pipe with an internal pipe traveled by the fluid to be cooled and an external pipe defining with the internal pipe a space traveled by a cooling fluid, and a union connection between said uncooled pipe and cooled double-wall pipe, the union connection including a connection part for connection between one end of the inlet duct of the fluid to be cooled and one end of the double-wall pipe, said connection part also forming a bottom wall of said space virtually transversal to a longitudinal extension of the double-wall pipe, the connection part of the union connection having an annular form with a U-shaped cross section piece having two legs and a perpendicularly extending interconnecting crosspiece to define two annular shanks extending longitudinally to the double-wall pipe with each shank being welded to one end of one of the two pipes of the double-wall pipe, a bottom of the connection part being a bottom wall of the space, and said one end of the inlet duct is welded to a radially inner portion of the connection part at said bottom wall of the space such that an interior diameter of the inlet duct is approximately equal to an internal diameter of the internal pipe of the double-wall pipe;

the bottom wall of the space having a thickness almost equal to the thickness of a wall of the internal pipe of the double-wall pipe;

the inlet duct is coaxial with the double-wall pipe.

* * * * *